US007950646B2

(12) United States Patent
Scheltes et al.

(10) Patent No.: US 7,950,646 B2
(45) Date of Patent: May 31, 2011

(54) METHOD FOR ADJUSTING A FOLDING STATION AND INSERTING SYSTEM

(75) Inventors: Rene Scheltes, Drachten (NL); Jan Jacobus Peter Remijnse, Meppel (NL)

(73) Assignee: Neopost Technologies, Bagneux (FR)

( * ) Notice: Subject to any disclaimer, the term of this patent is extended or adjusted under 35 U.S.C. 154(b) by 545 days.

(21) Appl. No.: 11/966,888

(22) Filed: Dec. 28, 2007

(65) Prior Publication Data

US 2008/0209860 A1 Sep. 4, 2008

(30) Foreign Application Priority Data

Dec. 30, 2006 (EP) ..... 06027126

(51) Int. Cl.
*B65B 57/10* (2006.01)

(52) U.S. Cl. .... 270/58.06; 270/32; 533/493; 533/284.3; 533/569

(58) Field of Classification Search ..... 270/58.06, 270/32; 53/493, 117, 284.3, 569
See application file for complete search history.

(56) References Cited

U.S. PATENT DOCUMENTS

| | | | | |
|---|---|---|---|---|
| 4,034,210 | A * | 7/1977 | Hill et al. | 235/487 |
| 4,862,386 | A * | 8/1989 | Axelrod et al. | 715/236 |
| 4,985,013 | A | 1/1991 | van der Werff et al. | |
| 5,339,603 | A | 8/1994 | Gombault et al. | |
| 5,558,232 | A | 9/1996 | Stevens et al. | |
| 5,640,835 | A * | 6/1997 | Muscoplat | 53/569 |
| 5,680,742 | A * | 10/1997 | Hidding | 53/411 |
| 5,683,338 | A * | 11/1997 | Krasuski et al. | 493/23 |
| 6,412,255 | B2 * | 7/2002 | Hidding et al. | 53/460 |
| 6,425,223 | B1 * | 7/2002 | Miller et al. | 53/381.6 |
| 7,104,034 | B2 * | 9/2006 | Stemmle | 53/493 |
| 7,219,482 | B2 * | 5/2007 | Stemmle | 53/429 |
| 2006/0026927 | A1 * | 2/2006 | Stemmle | 53/429 |
| 2006/0033262 | A1 | 2/2006 | Stemmle | |
| 2010/0145883 | A1 * | 6/2010 | Guyett et al. | 705/406 |

FOREIGN PATENT DOCUMENTS

| | | | |
|---|---|---|---|
| EP | 0498515 | A1 | 8/1992 |
| EP | 1625942 | A2 | 2/2006 |

* cited by examiner

*Primary Examiner* — Patrick Mackey
(74) *Attorney, Agent, or Firm* — Sughrue Mion, PLLC

(57) ABSTRACT

For determining a setting of an apparatus for folding documents to be inserted into windowed envelopes, a tentative folding setting is determined. Then, an overlay image representing the envelope and at least a portion of a side of the folded document that would be visible through the envelope window after folding of the specimen of the documents in accordance with the tentative folding setting and insertion of the folded specimen into the envelope is displayed. If the overlay image is not satisfactory, another tentative folding setting is inputted and an accordingly changed overlay image is generated. If the overlay image is satisfactory, the current tentative folding setting is selected as the folding setting to be applied for folding documents.

11 Claims, 4 Drawing Sheets

METHOD FOR ADJUSTING A FOLDING STATION AND INSERTING SYSTEM

FIELD AND BACKGROUND OF THE INVENTION

The invention relates to a method for adjusting a folding station and to an inserting system adjustable in accordance with such a method.

Determining a setting for a folding station such that documents are folded to dimensions properly fitting into envelopes of a given type and such that address data or other required data appear behind a window of the envelope neatly and reliably can be a cumbersome task, in particular if the adjustment is to be carried out by an inexperienced operator.

An example of a solution for facilitating the determination of folding settings is described in U.S. Pat. No. 5,339,603. According to this document, for determining whether the address appears behind a window properly, a sample mail piece is produced and if the address is found to be located too high, too low or on a side of a panel that is not visible through the window at all, the folding setting can be adjusted.

In U.S. patent application 2006/0026927, it is described to scan a windowed envelope to determine the location of the window on the envelope and to determine the location of a data block on a document that is to be visible behind the window of the envelope after the document has been folded and inserted in the envelope. From these data, the fold pattern is automatically determined such that the data block will appear behind the window of the envelope after the document has been folded in accordance with the determined fold pattern and inserted in the envelope. However, the determination of the location and dimensions of the data block requires knowledge about the lay-out of the documents or at least sufficient insight in the magnitude of variation between long and short addresses and, in this determination, mistakes can easily be made.

SUMMARY OF THE INVENTION

It is an object of the present invention to provide a solution that makes it more easy to determine a fold pattern that ensures that address data or other data on each of a series of documents appear behind a window of an envelope of the type into which the documents are to be inserted after the folded documents have been inserted into envelopes of that type.

According to one aspect of the invention, this object is achieved by providing a method for determining a setting of an apparatus for folding documents to be inserted into windowed envelopes, in which:

envelope type data representing envelope dimensions and a position and dimensions of a window in the envelopes of the type are obtained;

document data representing an image of a specimen of documents to be inserted into envelopes of the type and at least the length of each of the documents are obtained;

a tentative folding setting from the data representing the document dimensions and the envelope dimensions is determined; and in at least one setting cycle:

a) the envelope type data are processed, the data representing an image of a specimen of the documents and the tentative folding setting into an overlay image representing the envelope and at least a portion of a side of the folded document that would be visible through the envelope window after folding of the specimen of the documents in accordance with the tentative folding setting and insertion of the folded specimen into an envelope of the type;

b) the overlay image is displayed to an operator; and if the overlay image is not satisfactory, another tentative folding setting is inputted or, if the overlay image is satisfactory, the tentative folding setting is selected as the folding setting to be applied for folding documents.

The invention can also be embodied in an inserting system that includes:

a feeding station for feeding documents;

a folding station for folding documents, connected to the feeding station for receiving documents to be folded from the feeding station, wherein the folding station is adjustable for at least adjusting lengths of panels into which the documents are folded;

an inserting station for inserting documents into envelopes, connected to the folding station for receiving folded documents from the folding station; and a data processing assembly with a graphic user interface and including a graphic display;

wherein the data processing assembly is arranged for:

obtaining envelope type data representing envelope dimensions and a position and dimensions of a window in the envelopes of the type;

obtaining document data representing an image of a specimen of documents to be inserted into envelopes of the type and at least the length of each of the documents;

determining a tentative folding setting from the data representing the document dimensions and the envelope dimensions; and carrying out at least one setting cycle comprising:

a) processing the envelope type data, the data representing an image of a specimen of the documents and the tentative folding setting into an overlay image representing the envelope and at least a portion of a side of the folded document that would be visible through the envelope window after folding of the specimen of the documents in accordance with the tentative folding setting and insertion of the folded specimen into an envelope of the type;

b) displaying the overlay image to an operator; and in response to an operator command indicating that the overlay image is not satisfactory, determining another tentative folding setting or, in response to an operator command indicating that the overlay image is satisfactory, selecting the tentative folding setting as the folding setting to be applied for folding documents.

Such an inserting system is specifically adapted for carrying out a method according to the invention.

By processing the envelope type data, the data representing an image of a specimen of the documents and the tentative folding setting into an overlay image representing the envelope and at least a portion of a side of the folded document that would be visible through the envelope window after folding of the specimen of the documents in accordance with the tentative folding setting and insertion of the folded specimen into an envelope of the type into which the documents are to be inserted and displaying the overlay image to an operator, a simulation of the appearance of the mail pieces when the tentative folding setting would be applied is made available to the operator without the need of producing a sample mail piece. From the simulated appearance of a completed mail piece, it is very easy and intuitive for an operator to determine whether adjustments to the folding setting are needed and in which sense the folding settings need to be adjusted. Moreover, if a changed folding setting has been entered, a renewed simulation of the appearance of a completed mail piece is shown, so that an operator can easily verify whether the changes would result in satisfactory mail pieces.

Particular elaborations and embodiments of the invention are set forth in the dependent claims.

Further features, effects and details of the invention appear from the detailed description and the drawings.

DETAILED DESCRIPTION

For a description of an example of an inserting system according to the invention, reference is first made to FIGS. 4-7. The inserting system according to the example shown is composed of three main stations depicted by interrupted lines: a feeding station 1, a folding station 2 and an inserting station 3.

The feeding station 1 is arranged for feeding documents 4 to the folding station 2.

Figure 5:
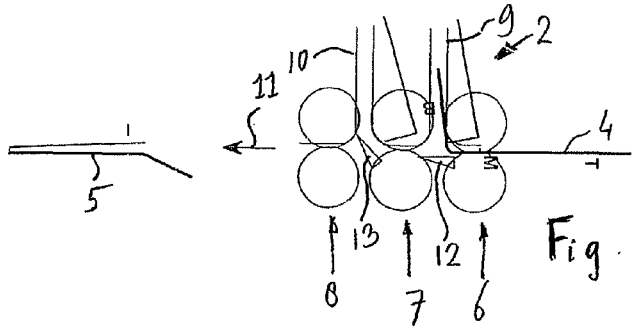
FIGS. 5-7 are schematic illustrations of further stages of operation of the inserting system shown in FIG. 4.
Figure 6:
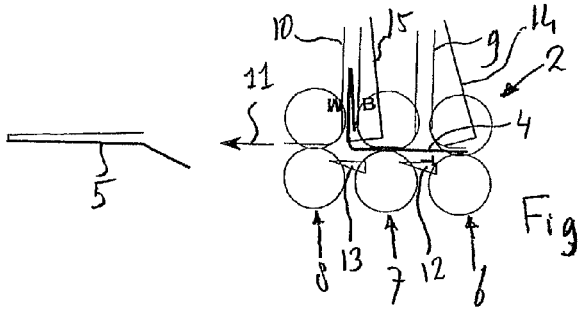
Figure 7:
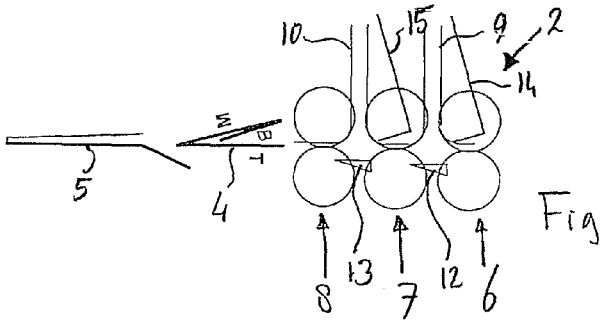

According to the present example, the folding station 2 is equipped with a pair of feed rollers 6, two pairs of folding rollers 7, 8, two folding chutes 9, 10, two deflectors 12, 13, each for selectively deflecting a document 4 into one of the folding chutes 9, 10 or allowing the document 4 to continue in a transport direction (arrow 11)-, and two folding knives 14, 15 each for pressing a deflected document 4 into a nip between one of the pairs of folding rollers 7, 8. The folding station 2 is arranged for folding documents 4, for example in a manner as shown in FIGS. 5-7 and is connected to the feeding station 1 for receiving documents 4 to be folded from the feeding station 1. The folding station 2 is adjustable for adjusting the number of folds to be made and the lengths of panels (in this example a top panel T, a middle panel M and a bottom panel B) into which the documents 4 are folded. A similar folding station is described in more detail in U.S. Pat. No. 4,985,013, but other types of adjustable folding assemblies may be used as well and are well known in the art.

The inserting station 3 is connected to the folding station 2 for receiving folded documents 4 from the folding station 3 and is arranged for inserting received documents 4 into envelopes 5.

For controlling the inserting apparatus, the apparatus is equipped with a data processing assembly 21 with a graphic user interface and a graphic display 22 in the form of an LCD screen. However, other graphic displays suitable for use with a graphic user interface, such as CRT display, can be provided as well. The data processing assembly 21 is connected to a scanner 16 for receiving scanning results, to a drive controller 17 for controlling the rollers 6-8, to a deflector controller 18 for controlling the deflectors 12, 13 and to folding knife controllers 19, 20 for controlling the folding knives 14, 15.

Figure 4:
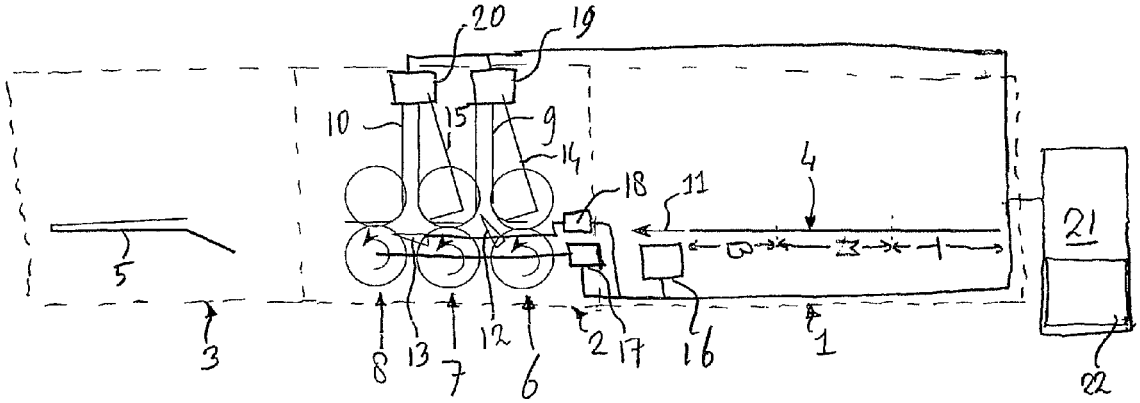
FIG. 4 is a schematic side view of an inserting system according to the invention.

In operation, a document 4 may for example be folded in accordance with a so-called "letter fold" folding pattern in which the document is folded into three panels, both outer panels T, B being folded to the same side of the middle panel M and one of the outer panels being folded into a position between the other outer panel and the middle panel. To achieve this, the first deflector 12 is brought in a deflecting position as shown in FIG. 4 before the document 4 is fed to the folding station 2. When the document 4 is fed, this causes the leading bottom end of the document 4 to enter the first folding chute 9, as is shown in FIG. 5.

Next, the first deflector 12 is returned to its position in which it allows a document 4 to pass into a nip between the first pair of folding rollers 7 and the first folding knife 14 is pivoted towards the nip between the first pair of folding rollers 7, thereby causing the document to be folded between the folding rollers of the first pair 7. The position in which the document 4 is at the moment the first folding knife 14 is moved towards the folding nip between the rollers of the first pair 7 determines the location on the document 4 where the first fold is to be made. In the present example, this also determines the length (perpendicular to the fold) of the bottom panel B. To determine this position, the leading edge of document 4 is sensed by a sensor (not shown), positioned just upstream of feeding rollers 6. The displacement of the document 4 from the sensor is measured by counting pulses generated by a pulse disk sensor (not shown) that is coupled to the rollers 6-8. In this way the first folding position can be determined.

Before the document 4 is passed through the folding nip between the rollers of the first pair 7, the second deflector 13 is brought in a position for deflecting the document 4 into the second folding chute 10, as is shown in FIG. 5. When the document 4 is fed through the folding nip between the rollers of the first pair 7, this causes the leading bottom and middle panels B, M of the document 4 to enter the second folding chute 10 with the fold between these two panels B, M leading, as is shown in FIG. 6.

Next, the second deflector 13 is returned to its position in which it allows a document 4 to pass into a nip between the second pair of folding rollers 8 and the second folding knife 15 is pivoted towards the nip between the first pair of folding rollers 8, thereby causing the document 4 to be folded between the folding rollers of the second pair 8. The position in which the document 4 is at the moment the second folding knife 15 is moved towards the folding nip between the rollers of the second pair 8 determines the location on the document 4 where the second fold is to be made. The position of document 4 can be determined in the same way as for the first fold, by counting the pulses after the leading or trailing edge of the document 4 has passed a sensor (not shown). In the present example, this also determines the length (perpendicular to the fold) of the middle and top panels M, T.

The envelope 5 in the inserting station 3 is oriented with its side to which the closing flap is connected and where the window is located facing down. As is shown in FIG. 7, the document 4 leaves the nip between the rollers of the second pair 8 with its top panel facing down and the top end trailing so that, after insertion, the top end of the document 4 will be located closely adjacent a fold between the flap of the envelope and the rest of the envelope 5. If, as is usual, this is the top edge of the envelope 5, so that the document 4 is inserted in such an orientation that the top panel T will be visible behind the window of the envelope 5 and if the document 4 was fed with an address on the top panel facing downwardly, the side of the top panel T on which the address is printed will be visible behind the window of the envelope. In this example, the only remaining issue is, whether the location of the address after folding matches the location of the window in the envelope, so that the address, which may include a bar code, is completely visible behind the window.

It is observed, that a Z-fold can be made by controlling the first folding knife 14 such that the first fold is made in a position with the longest portion of the document, intended to form two panels, deflected into the first folding chute 9 and the second fold is made in a position in the longest panel after only the first fold was made that is further away from the first fold than the length of the shortest panel after only the first fold was made. In that case, the panel adjacent the edge of the document that was leading when the document was fed will be visible behind the window of the envelope. Moreover, the side of that panel that will be visible facing the window of the envelope will be side facing upwardly when the document was fed. This means that to achieve that the address will appear behind the window of the envelope, the document should be oriented face-up and with address on the leading portion of the document.

Also other fold patterns are possible, such as a single fold (which leaves open the option of using one of the folding chutes for reversing the document only). These examples illustrate, that the selected fold pattern affects the orientation in which a document is to be fed if an address or other information on the document is to appear behind the window of the envelope.

Figure 1:
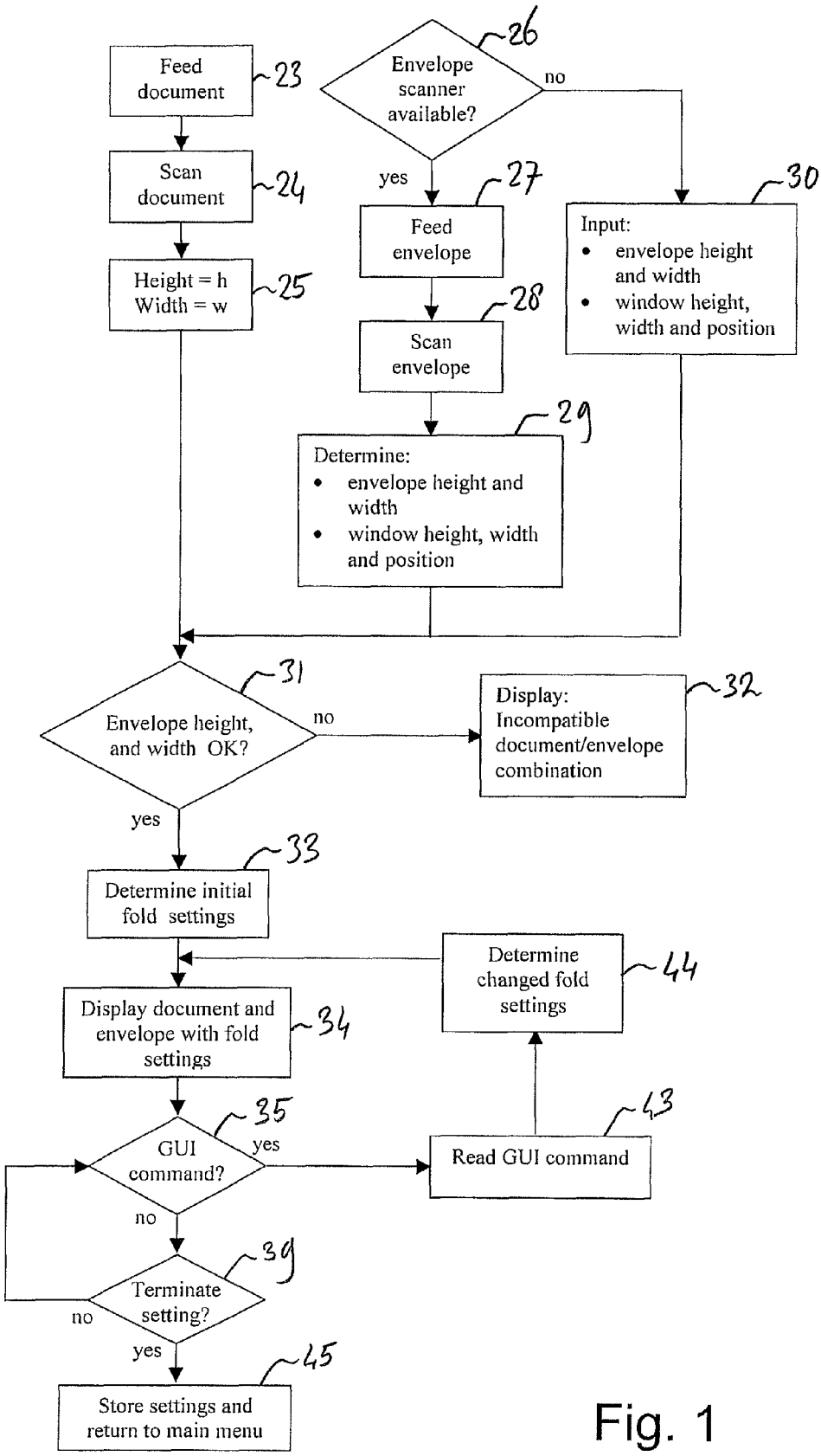
FIG. 1 is a flow chart representing an example of a method according to the invention.

According to the present example, the control system 21 is arranged to carry out a method represented by the flow chart in FIG. 1 for assisting the operator in determining whether the proper folding settings are applied and whether the documents have been loaded into the inserting system in the right orientation.

As a first step 23, the control system causes a specimen of the documents to be processed to be fed along the scanner 16. As the document passes the scanner 16, the document is scanned (step 24) so that document data representing an image of the scanned specimen 4 and the length of the specimen is obtained. Preferably, also data representing the width of the document are included in the scanning result, but if the document width is standardized, this may be a fixed value. As is indicated by step 25, the height h and width w of the document 4 are subsequently stored. The scanned document 4 may be returned to the documents to be inserted if it is led out of the apparatus without being folded or inserted. The document can for instance be led out of the apparatus via one of the folding chutes 9, 10, if that folding chute has an open end, by providing that the deflectors 12, 13 are in orientations for leading the document 4 into that folding chute 9, 10 without having been folded.

For obtaining the envelope data, it is first checked whether an envelope scanner is available (step 26). Such an envelope scanner may for instance be available as a stand-alone device or be incorporated in the inserting station. The apparatus may also be arranged such that it allows envelopes to be fed along the scanner 16. If the envelopes can be scanned in the apparatus, an envelope is fed (step 27) and scanned (step 28) and the envelope height and width as well as the height and width as well as the position on the envelope of the window are determined from the scanning result (step 29). If scanning of the envelopes is not possible, the envelope type data representing envelope dimensions and a position and dimensions of the window in the envelopes of the type to be used are inputted otherwise (step 30), for instance by reading input typed in via a keyboard, by reading from a memory or by communication with an external apparatus. Obtaining the envelope type data from a memory containing envelope type data provides the advantage that the step of scanning the envelope or otherwise inputting such data can be skipped and is in particular advantageous if, as is quite usual because envelopes tend to be standardized, the number of different envelope types that are used is quite small.

After all data to be used have been gathered, it is first checked whether the documents to be inserted are compatible with the type of envelopes into which the documents are to be inserted (step 31). If the envelopes are not compatible with the documents, a warning indicating the incompatibility is displayed (step 32).

If no incompatibility has been found, as a next step 33, a provisional folding setting is determined. If this folding setting provides that the document is not to be folded at all, changing the folding setting cannot change the position of the address relative to the window in the envelope. However, in such a situation, the method according to the invention can still be used for ascertaining that the documents have been loaded in the right orientation, provided the document image has been obtained by scanning the document fed through the inserting apparatus.

If the provisional folding setting 33 provides for at least one fold and a for a position of the fold or folds from the data representing the document dimensions and the envelope dimensions, adjustment of the folding setting allows to change the position of the printed data to ascertain that the required data will appear behind the window of the envelope. The determination of the initial folding setting may be carried out in a known manner. Examples of manners of determining folding settings from document and envelope heights are described in U.S. Pat. No. 5,339,603.

After the provisional fold settings have been determined, a setting cycle consisting of the steps 34, 35 is carried out at least once.

Figure 2:
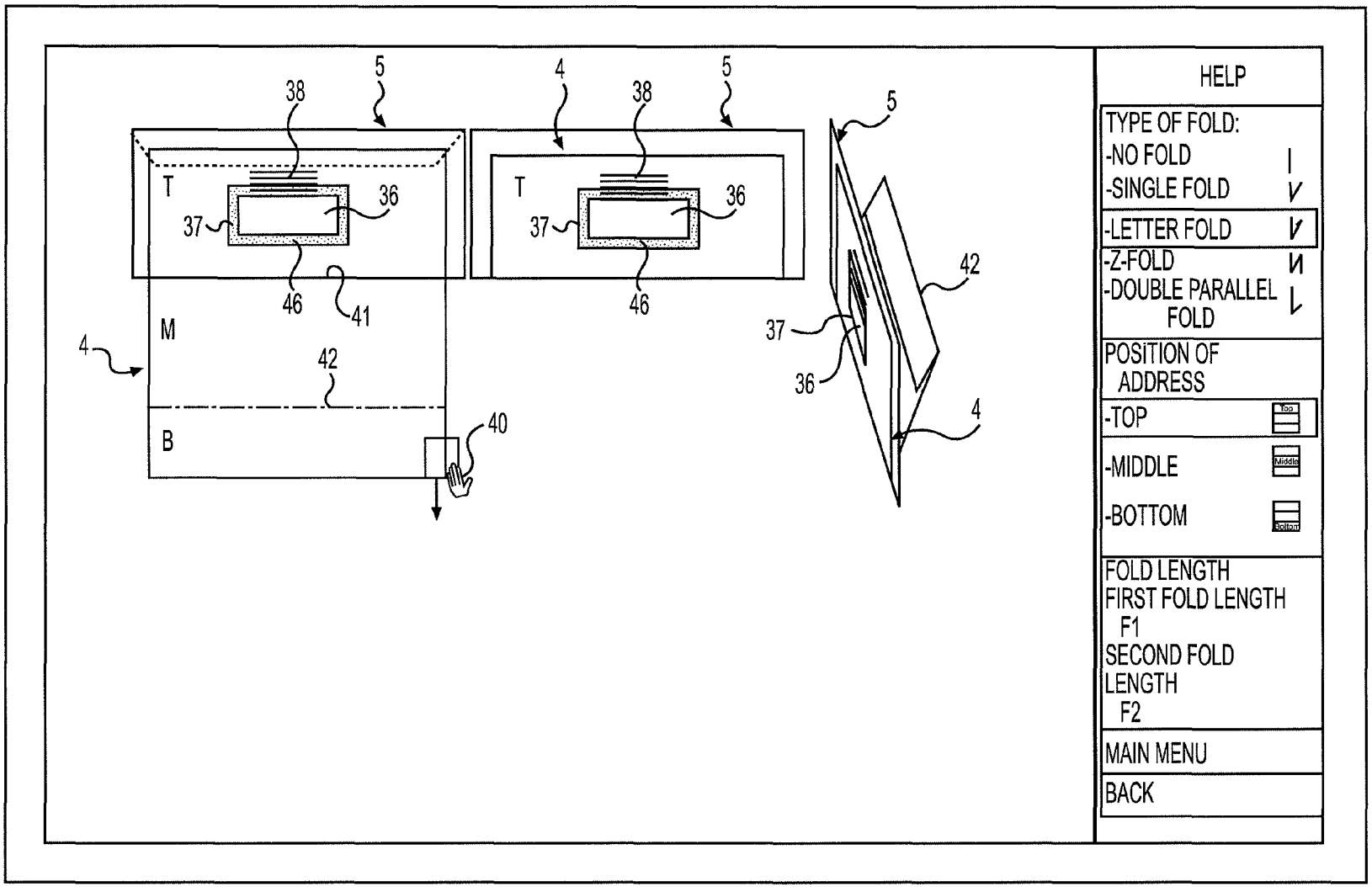
FIG. 2 is an example of an overlay image shown in the course of an example of a method according to the invention.

In step 34, the envelope type data, the data representing an image of a specimen of the documents and the tentative folding setting are processed into an overlay image. An example of such an image is shown in FIG. 2. The image according to the present example includes three representations of the envelope 5 and of a portion 36 of a side of the folded document 4 that would be visible through the envelope window 37 after folding of the specimen of the documents in accordance with the tentative folding setting and insertion of the folded specimen into the envelope 5. In the left-hand representation, the document 4 is shown in unfolded condition, the positions of one fold 41 being in line with a bottom end of the envelope 5 and the position of the other fold being represented by a dash-and-dot line 42. The central representation shows the folded document 4 and the envelope 5. In the right-hand representation, the envelope 5 is shown together with the document 4 folded slightly open in perspective view, to show the folding pattern of the document 4 in relation to the envelope 5. The determined overlay image is displayed to an operator using the display 22.

As can be seen in FIG. 2, the image shows that the address 38 would not appear completely behind the window 37, but would arrive in a position that is too high in relation to the window 37 of the envelope 5. As represented by the step 35 in FIG. 1, the control system awaits a command from the user to change the folding settings or to terminate the setting procedure (step 39).

According to the present example, an operator can enter a command indicating that the overlay image is not satisfactory via the graphic user interface by operating a pointer device such as a mouse, a trackball, a touch screen or a touchpad to control a dragging pointer 40 by means of which the representation of the document 4 can be dragged into a position in which the address 38 appears behind the window 37 in a satisfactory manner. In the present example, this is achieved by dragging the representation of the document 4 downwardly. Because the changed tentative folding setting is inputted by causing a portion 4 of the image representing the document to be displaced relative to a portion 5 of the image representing the envelope, inputting changed folding settings can be carried out in a very straightforward and intuitive manner. The inputting of changed folding settings is made particularly easy, because the portion 4 of the image representing the document is displaced by causing that portion 4 of the image representing the document to be dragged over the display 22 in accordance with displacement of a pointer.

In the flow chart in FIG. 1, if a graphic user interface command has been entered, step 43 provides for the reading of the commands entered via the graphic user interface. In step 44 a changed tentative folding setting is determined from the initial tentative folding setting and the commands entered via the graphic user interface.

In the present example the current tentative folding settings are displayed in a window to the right of the image under the heading fold length. In this window also the type of fold, the panel on which the address is located and links to other windows are displayed.

After step 44, the adjustment cycle returns to step 34 in which a new overlay image showing representations 4, 5 of the envelope and the document in relative positions corresponding to the changed folding settings. An example of such a changed overlay image is shown in FIG. 3.

Figure 3:
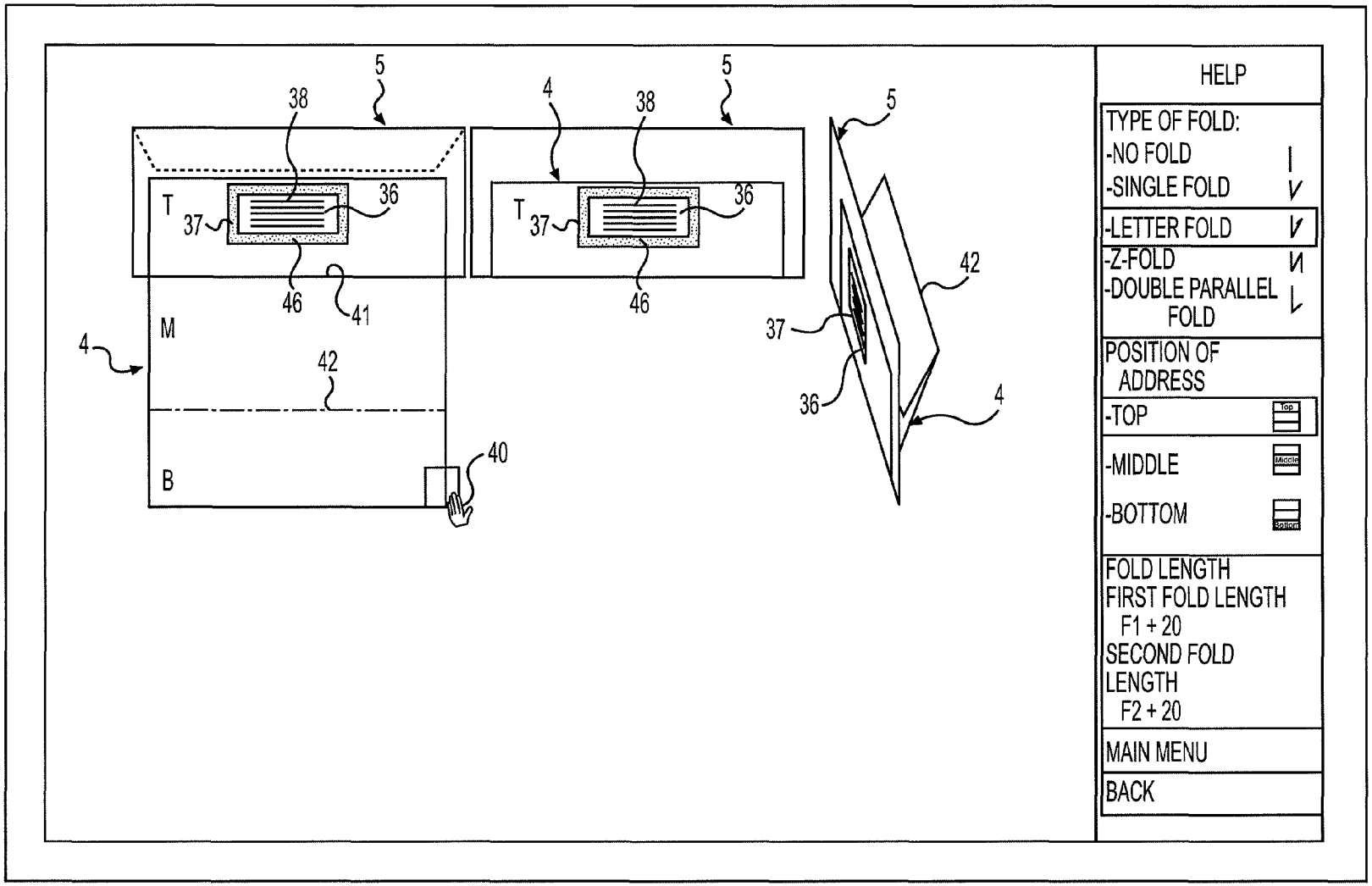
FIG. 3 is an example of an overlay image that shows how the image shown in FIG. 2 may have changed after changes to the folding setting have been inputted.

If the position of the address 38 in relation to the window 37 as shown in FIG. 3 is deemed to be satisfactorily, the operator enters a command to terminate the setting procedure so that the condition of the terminate setting variable interrogated in step 39 changes to "yes", thereby indicating that the overlay image is satisfactory. In response thereto, the control system 21 selects the current tentative folding setting as the folding setting to be applied for folding documents 4 (step 45).

Thus, because the changeable relative positions of the address on a specimen of the documents to be inserted and the window of the envelope into which the documents are to be inserted are displayed to the operator prior to operation in a production mode, the operator can check and change the address position in relation to the window in a simple and intuitive manner, which does not require particular knowledge about the underlying lay-out of the document.

When inserting documents into envelopes, it is usual to leave a certain margin between the size of the document (which may be folded or not) and the envelope. This entails that a document is to a limited extent movable inside the envelope, so that also the address can move accordingly relative to the window in the envelope. To ensure that a position of the address relative to the window of the envelope is selected in which the address will appear fully behind the window of the envelope, a margin of a width corresponding to a width of a margin between the folded document and the envelope of the type to be used, after the document would have been inserted therein may be displayed along the inside of a contour of the image of the window of the envelope. In the example shown in FIGS. 2 and 3, an example of such a margin is indicated by reference numeral 46. It is observed that the margin in vertical direction may be different from the margin in horizontal direction.

For the purpose of taking into account movability of the document inside the envelope, it is also possible to provide that the portion of the side of the folded document that would be visible is repeatedly moved relative to the image of the envelope, the magnitude of the movements corresponding to a width of the margin between the folded document and the envelope of said type after the document would have been inserted therein. Alternatively, the portion of the side of the folded document that would be visible may be shown at least twice, the distance and direction over which the images of the document are shifted relative to each other corresponding to a width of a margin between the folded document and the envelope after the document would have been inserted therein.

While the invention has been illustrated and described in detail in the drawings and foregoing description, such illustration and description are to be considered illustrative or exemplary and not restrictive; the invention is not limited to the disclosed embodiments.

For example, it is possible to provide that the document data representing an image of a specimen of documents to be inserted and at least the length of each of said documents are obtained otherwise than by scanning. The document data may for instance be obtained by reading from a memory, via a communication network or by conversion of a file in a word processing or other editable format into an image format. However, an advantage of obtaining the document image by scanning a specimen of the documents fed from a feeder of the inserting system is, that errors in the orientation of the document will also be revealed in the overlay image, because the address would then not appear at the side of a panel of the document facing the envelope window at all.

Also, the commands for changing the fold settings can also be entered otherwise than via a graphic user interface, for instance using dedicated buttons, via buttons having functions assignable by software or by entering predetermined and variables defining the requested change via a keyboard.

It is also possible to facilitate selecting a folding setting by determining at least two tentative folding settings and associated overlay images and displaying these overlay images simultaneously or alternatingly. The operator can then begin by selecting the image and the associated folding setting that resembles the desired end result most closely.

Other variations to the disclosed embodiments can be understood and effected by those skilled in the art in practicing the claimed invention, from a study of the drawings, the disclosure, and the appended claims.

The invention claimed is:

1. A method for determining a setting of an apparatus for folding documents to be inserted into windowed envelopes, comprising:

obtaining envelope type data representing envelope dimensions and a position and dimensions of a window in the envelopes of said type;

obtaining document data representing an image of a specimen of documents to be inserted into envelopes of said type and at least the length of each of said documents;

determining a tentative folding setting from the data representing the document dimensions and the envelope dimensions; and at least one setting cycle comprising:

c) processing the envelope type data, the data representing an image of a specimen of the documents and the tentative folding setting into an overlay image representing the envelope and at least a portion of a side of the folded document that would be visible through the envelope window after folding of the specimen of the documents in accordance with the tentative folding setting and insertion of the folded specimen into an envelope of said type;

d) displaying the overlay image to an operator; and e) if the overlay image is not satisfactory, inputting another tentative folding setting or, if the overlay image is satisfactory, selecting the tentative folding setting as the folding setting to be applied for folding documents.

2. A method according to claim 1, wherein the document data representing an image of a specimen of documents to be inserted into the envelopes are obtained by scanning a specimen of said documents to be inserted in the envelopes of said type.

3. A method according to claim 1, wherein the envelope type data are 5 obtained by scanning the envelope.

4. A method according to claim 1, wherein the envelope type data are obtained from a memory containing envelope type data.

5. A method according to claim 1, wherein said other tentative folding setting is inputted causing a portion of the image representing the document to be displaced relative to a portion of the image representing the envelope.

6. A method according to claim 5, wherein the portion of the image representing the document is displaced by causing the portion of the image representing the document to be dragged over the display in accordance with displacement of a pointer.

7. A method according to claim 1, wherein at least two tentative folding settings are determined and associated overlay images are displayed simultaneously or alternatingly.

8. A method according to claim 1, wherein a margin of a width corresponding to a width of a margin between the folded document and the envelope of said type after the document would have been inserted therein is displayed along the inside of a contour of a portion of the image representing the window of the envelope.

9. A method according to claim 1, wherein said portion of the side of the folded document that would be visible is repeatedly moved relative to the portion of the image representing the envelope, the magnitude of the movements corresponding to a width of a margin between the folded document and the envelope of said type after the document would have been inserted therein.

10. A method according to claim 1, wherein the portion of the side of the folded document that would be visible is shown at least twice, the distance and direction over which images portions are shifted relative to each other corresponding to a width of a margin between the folded document and the envelope of said type after the document would have been inserted therein.

11. An inserting system comprising:

a feeding station for feeding documents;

a folding station for folding documents, connected to the feeding station for receiving documents to be folded from the feeding station, wherein the folding station is adjustable for at least adjusting lengths of panels into which the documents are folded;

an inserting station for inserting documents into envelopes, connected to the folding station for receiving folded documents from the folding station; and a data processing assembly with a graphic user interface and including a graphic display;

wherein the data processing assembly is arranged for:

obtaining envelope type data representing envelope dimensions and a position and dimensions of a window in the envelopes of said type;

obtaining document data representing an image of a specimen of documents to be inserted into envelopes of said type and at least the length of each of said documents;

determining a tentative folding setting from the data representing the document dimensions and the envelope dimensions; and carrying out at least one setting cycle comprising:

c) processing the envelope type data, the data representing an image of a specimen of the documents and the tentative folding setting into an overlay image representing the envelope and at least a portion of a side of the folded document that would be visible through the envelope window after folding of the specimen of the documents in accordance with the tentative folding setting and insertion of the folded specimen into an envelope of said type;

d) displaying the overlay image to an operator; and e) in response to an operator command indicating that the overlay image is not satisfactory, determining another tentative folding setting or, in response to an operator command indicating that the overlay image is satisfactory, selecting the tentative folding setting as the folding setting to be applied for folding documents.

* * * * *